US005092093A

United States Patent [19]

Lu

[11] Patent Number: 5,092,093

[45] Date of Patent: Mar. 3, 1992

[54] PANEL FORMS HAVING PANEL REINFORCING MEANS

[76] Inventor: Shin-Yuang Lu, No. 123-2, Sung-Chiao Village, Kuan-Miao Hsiang, Tainan Hsien, Taiwan

[21] Appl. No.: 636,263

[22] Filed: Dec. 31, 1990

[51] Int. Cl.[5] ..... E04B 2/28; E04B 5/00; B22D 19/00

[52] U.S. Cl. ..... 52/426; 52/429; 52/431; 52/562; 249/83; 249/135

[58] Field of Search ..... 52/424, 425, 426, 427, 52/429, 430, 431, 562; 249/83, 85, 117, 135

[56] References Cited

U.S. PATENT DOCUMENTS

| | | | |
|---|---|---|---|
| 995,069 | 6/1911 | Lewen | 52/431 |
| 1,724,284 | 8/1929 | Henetsky et al. | 52/562 |
| 2,825,221 | 3/1958 | Brouk | 52/425 |
| 3,490,187 | 1/1970 | Stauffer et al. | 52/562 |
| 3,751,867 | 8/1973 | Layne | 52/426 |
| 4,717,517 | 1/1988 | Halberstadt | 249/83 X |
| 4,938,449 | 7/1990 | Boeshart | 52/562 X |

FOREIGN PATENT DOCUMENTS

| | | | |
|---|---|---|---|
| 272033 | 6/1927 | United Kingdom | 52/426 |

*Primary Examiner*—David A. Scherbel
*Assistant Examiner*—Robert Canfield
*Attorney, Agent, or Firm*—Bacon & Thomas

[57] ABSTRACT

A form for walls and the like of the type formed by two parallel, facing molding surfaces each of the surfaces being formed by a plurality of panels, each panel having a rigid frame formed with an inner flange at one side and spaced holes, a plate with a major side attached to the inner flange of the frame, cellular reinforcing body made of plural wavy metallic strips in stacking condition and sandwiched between two wire nets, the reinforceing body is attached to the major side of the plate within the frame, and spacing units for simultaneously locking two layers of adjacent panels in opposed arrangement to provide great rigidity in the assembled form.

4 Claims, 9 Drawing Sheets

PANEL FORMS HAVING PANEL REINFORCING MEANS

BACKGROUND OF THE INVENTION

The present invention relates to wall forms, and more particularly to such forms of type wherein two surfaces face each other to delimit the surfaces of the wall to be formed.

Modular reuseable type of formworks for concrete, and especially those for use with vertical planar areas of some areal extent, have been found desirable in the concrete arts and in response many forms of such structure have become known. Some of such forms are constructed with wooden elements, as shown in FIG. 1. The wooden elements have advantages that they are less expensive and easily workable but on the other hand they are not so durable and generally do not provide the same strength for equal mass.

SUMMARY OF THE INVENTION

An object of the present invention is to provide panel forms having panel reinforcing means which are light and of reduced dimension so that manual handling is possible.

Another object of the present invention is to provide panel forms which are mounted in situ, piece by piece, fixing one to the other until the perimeter of the construction is completed with a layer of panels.

A further object of the present invention is to provide panel forms which impart the concrete construction to be constructed therewith that permits the obtainment of thinner walls, which means economy of material, a better finish, exact size and labour saving.

Other and further objects of the present invention will appear from the following specification and accompanying drawings which form a part hereof. In carrying out the objects of the present invention, it is to be understood that its essential features are susceptible of change in design and structural arrangement with two preferred and practical embodiments being illustrated in the accompanying drawings.

DETAILED DESCRIPTION OF THE PREFERRED EMBODIMENTS

Figure 1:
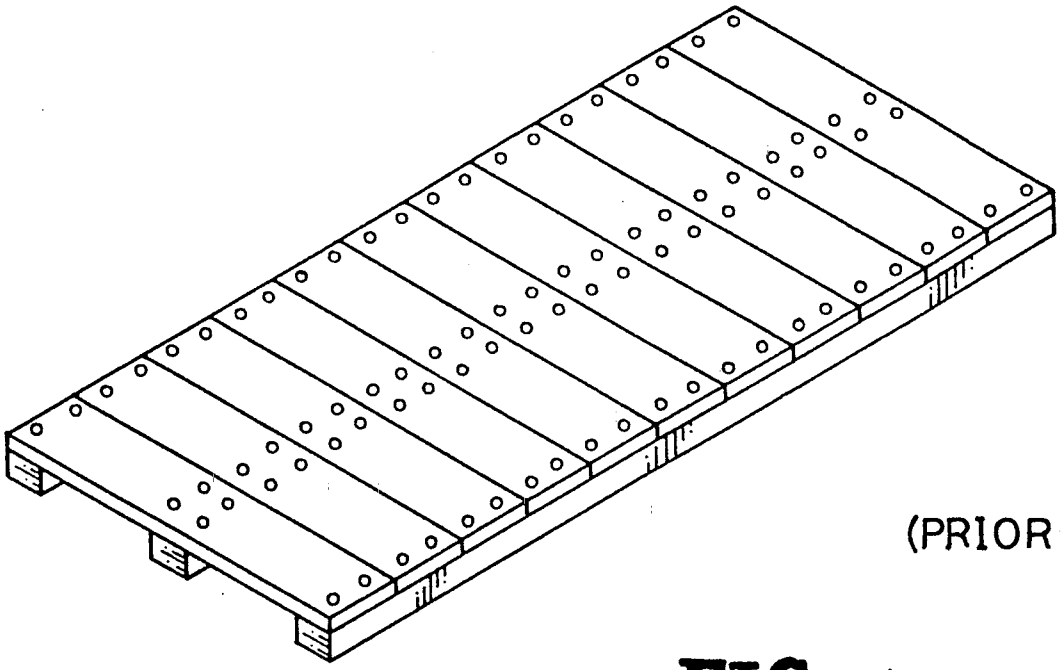
(PRIOR ART) FIG. 1
FIG. 1 is a modular reuseable type of wooden formwork for concrete.
Figure 2:
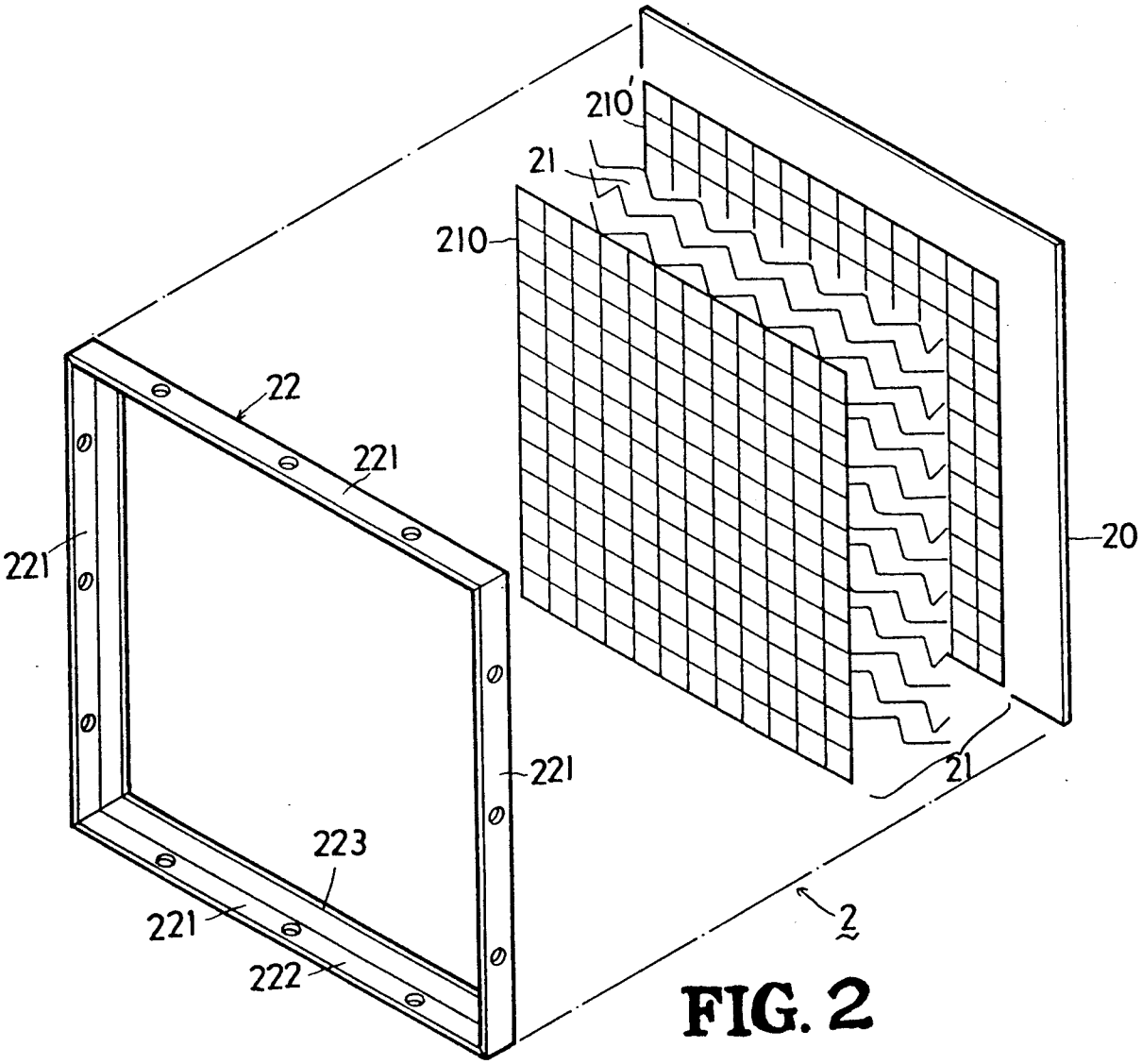
FIG. 2 is an exploded perspective view of a panel form of a first preferred embodiment according to the present invention.

Referring to FIG. 2, a panel form 2 according to the present invention includes a rectangular frame 22 formed with two pairs of opposed angle irons 221 each of which includes a main plate 222 and a bent plate or flange 223. The main plate 222 defines plural spaced holes 200 generally arrayed along the center line thereof. A plate 20 is attached to the outer side of the flange 223 by means of, for example, welding. Two opposed wire nets 210, 210' of different dimensions, one smaller inner net 210 and one bigger outer net 210', sandwich a cellular body, which is made of plural stacked wavy metallic strips 211 as a reinforcement unit 21 to serve the function of reinforcement. The contacts between the wavy metallic strips and each wire not 210 or 210' are further secured by means of spot welding. Said reinforcement unit 21 is attached to inner surface of the plate 20 by means of welding.

Figure 3:
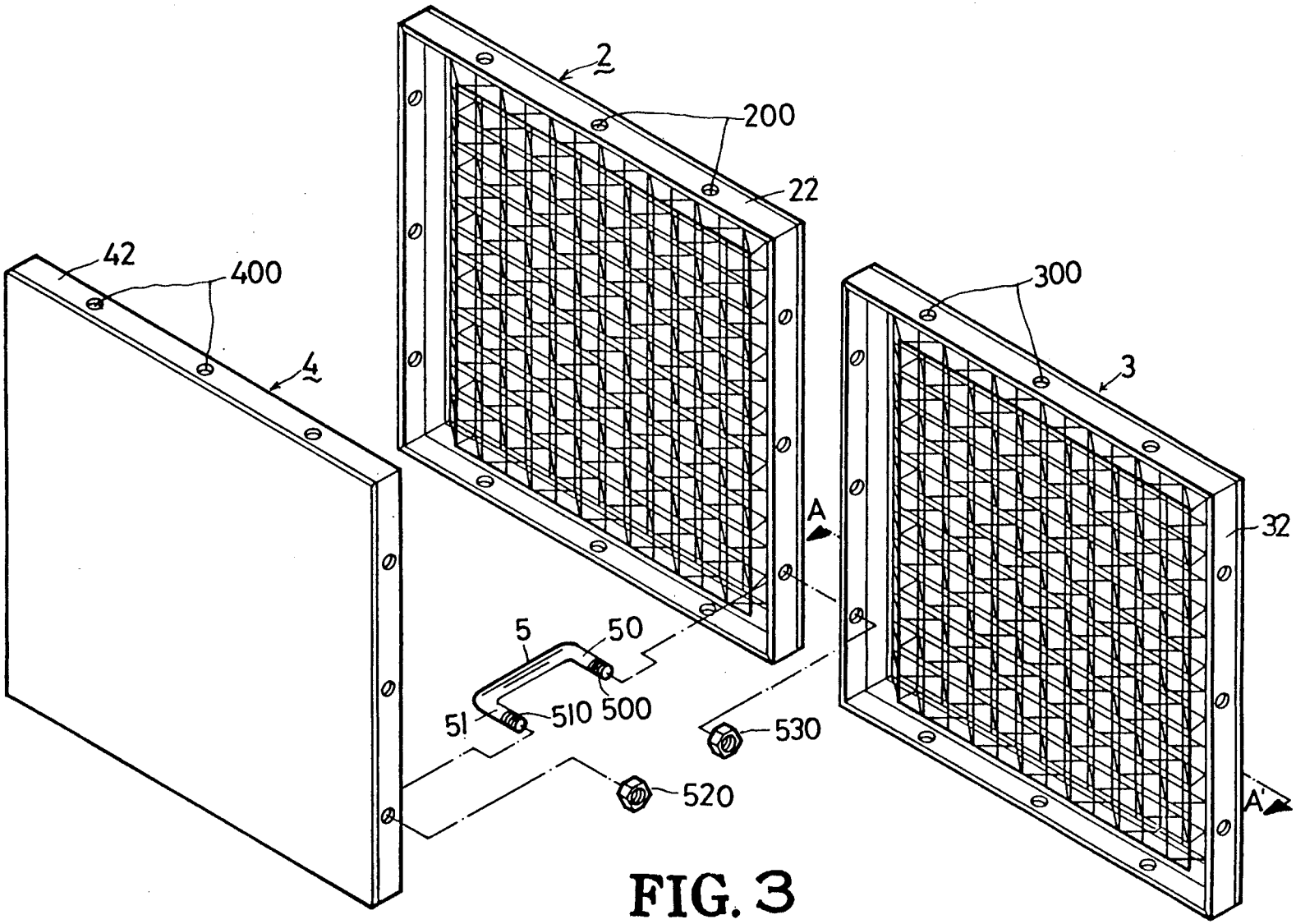
FIG. 3 is an exploded perspective view of a panel form of the first embodiment which are to be mounted for a concrete construction.
Figure 4:
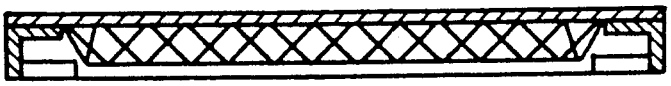
FIG. 4 is a sectional view of a panel form taken along line A—A in the FIG. 3.

Referring to FIGS. 3 & 4, in order to form a construction such as a wall, the form panels 2, 3, 4 are mounted in situ, piece by piece, fixing one to the other until the perimeter of the constuction is completed with a layer of opposed panels. The concrete is then poured to correspond to layer of opposed panels followed by the assembly of another layer on top of the previous one, etc., thus reaching, by stages, the total height of the structure. Form panel 3 for coplanar assembly, the one adjacent to the form panel 2 and form panel 4 for spaced assembly, the one opposed to the form panel 2, are all identical in constuction to the form panel 2. The holes 300, 400 of the panel forms 3, 4 are normally arranged in uniformly spaced, rectilinear plan that will allow the panels to be used either horizontally or vertically with a similar spacing of holes in the frames 32, 42 to allow matching.

Figure 6:
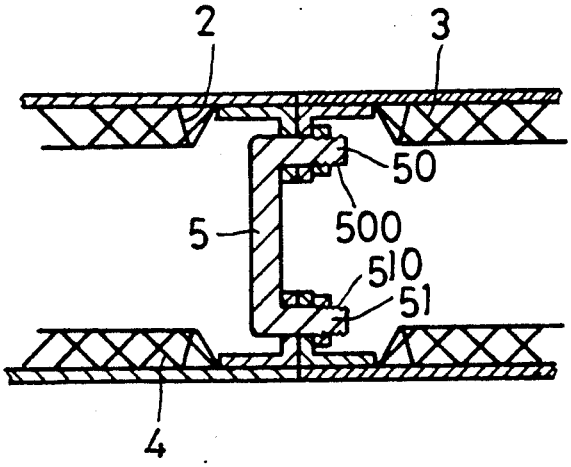
FIG. 6 is an enlarged sectional view of a joining section of the two adjacent panel forms of the first embodiment.
Figure 5:
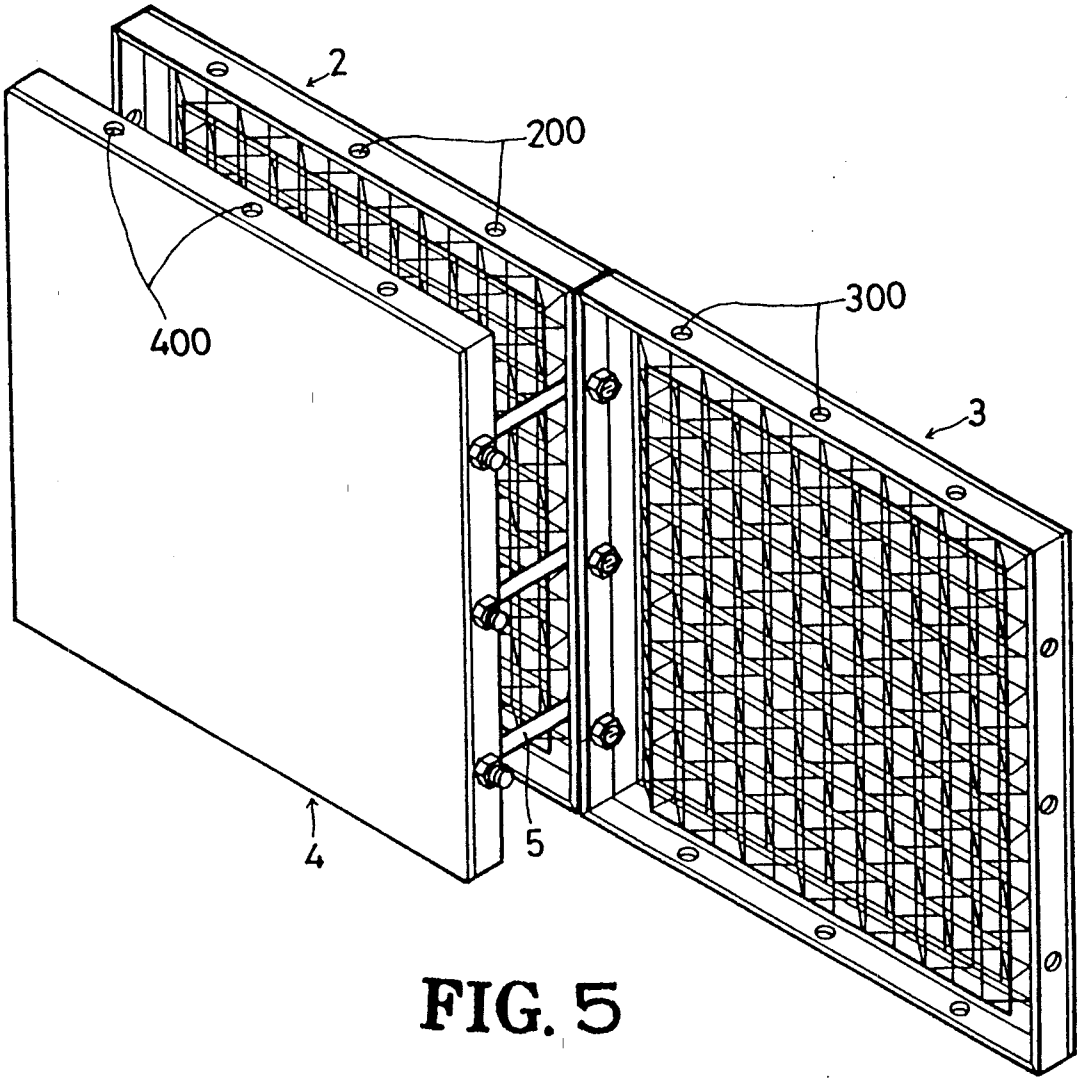
FIG. 5 is a perspective view of the first embodiment of the panel forms which are in partially assembled condition.

A plurality of supporting spacers 5 are used for simultaneously joining two adjacent panels 2, 3 and opposed panel 4. The supporting spacer 5 includes two parallel shanks 50, 51 respectively formed with threaded ends 500, 510 for extending through corresponding holes of adjacent panel forms and further tightly secured thereto by means of nuts 520, 530, as best shown in FIG. 5 & 6. The distance between the two parallel shanks 50, 51 of the spacer 5 determines the space between opposed form panels 2, 4. Separate spacers must be provided for each different spacing. After completion of a concrete structure such as a wall structure, the panel forms of the first preferred embodiment are left still to form the outer parts of the wall structure so as to obtain a thinner wall of economic material, a better finish, an exact size and especially a labour saving.

A modified embodiment, as shown in FIGS. 7 to 12, is provided in the present invention. The panel form 2 of the second embodiment according to the present invention also includes a rectangular frame 22 formed with two pairs of opposed angle irons 221 each of which includes a main plate 222 and a flange 223. The main plate 222 defines plural spaced holes 200 generally arrayed along the center line thereof. A plate 22 forming a rectangular molding surface is attached to the outer side of the flange 223 by means of, for example, welding. Four holes 201 are located at the four corners of the plate 20.

Two opposed rectangular wire nets 210, 210' of different dimensions, one smaller inner net 210 and one bigger outer net 210' sandwich a cellular body, which is made of plural stacked wavy metallic strips 221 as a reinforcement unit 21 to serve the function of reinforcement. The contacts between the wavy metallic strips 221 and each wire net 210 or 210' are further secured by means of spot welding. Said reinforcement unit 21 is attached to inner surface of the plate 20 by means of welding.

The fastening rigidity of the frame 22 is reinforced by means of four reinforcement pieces 23 respectively welded in the four corners thereof. Corner screw holes 231 are formed in the reinforcement pieces 23.

Figure 7:
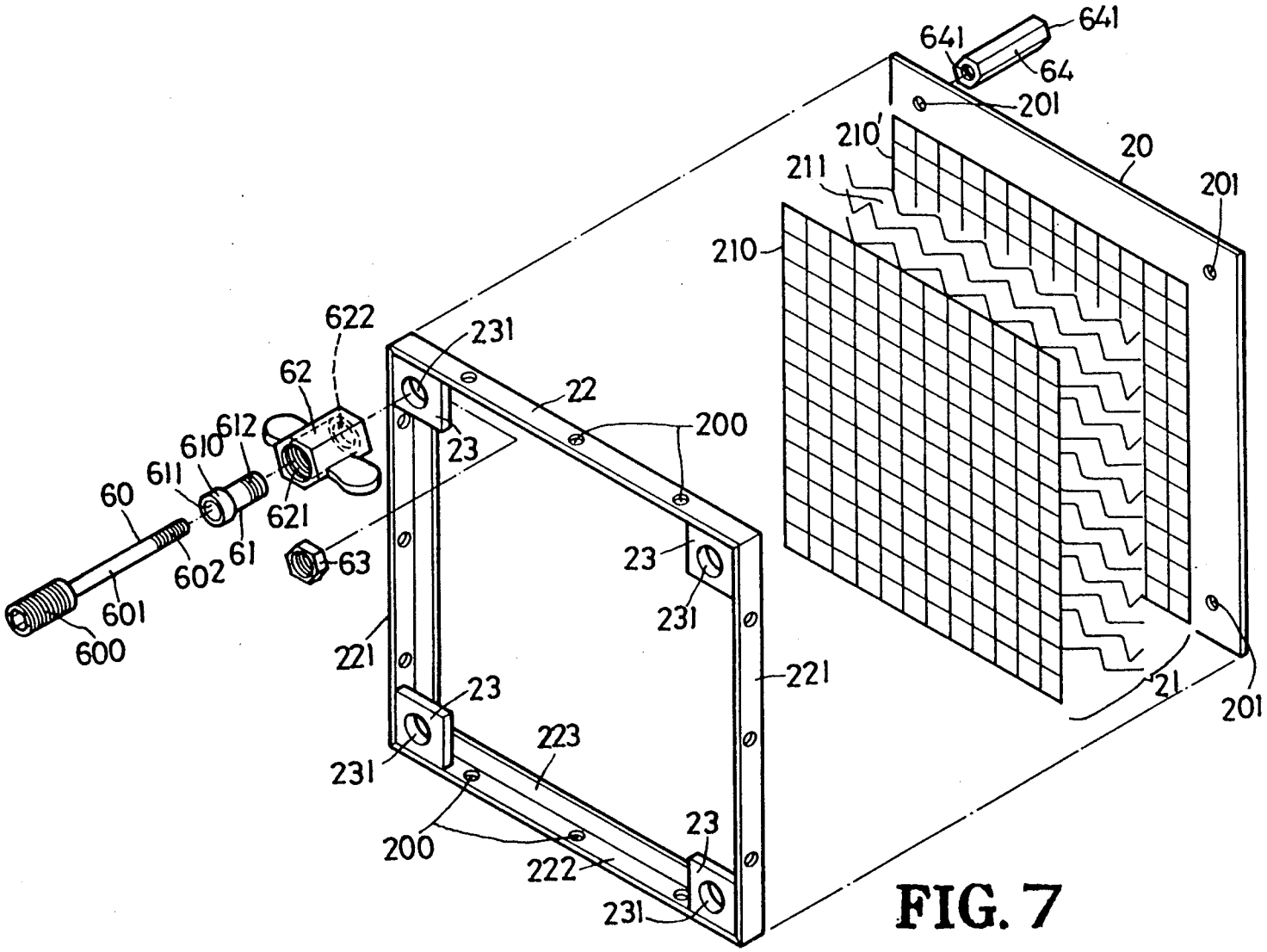
FIG. 7 is an exploded perspective view of a second preferred embodiment of a panel form according to the present invention.
Figure 9:
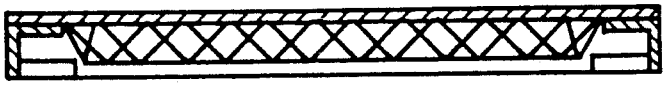
FIG. 9 is a sectional view of the panel form taken along line C—C' in the FIG. 8.
Figure 8:
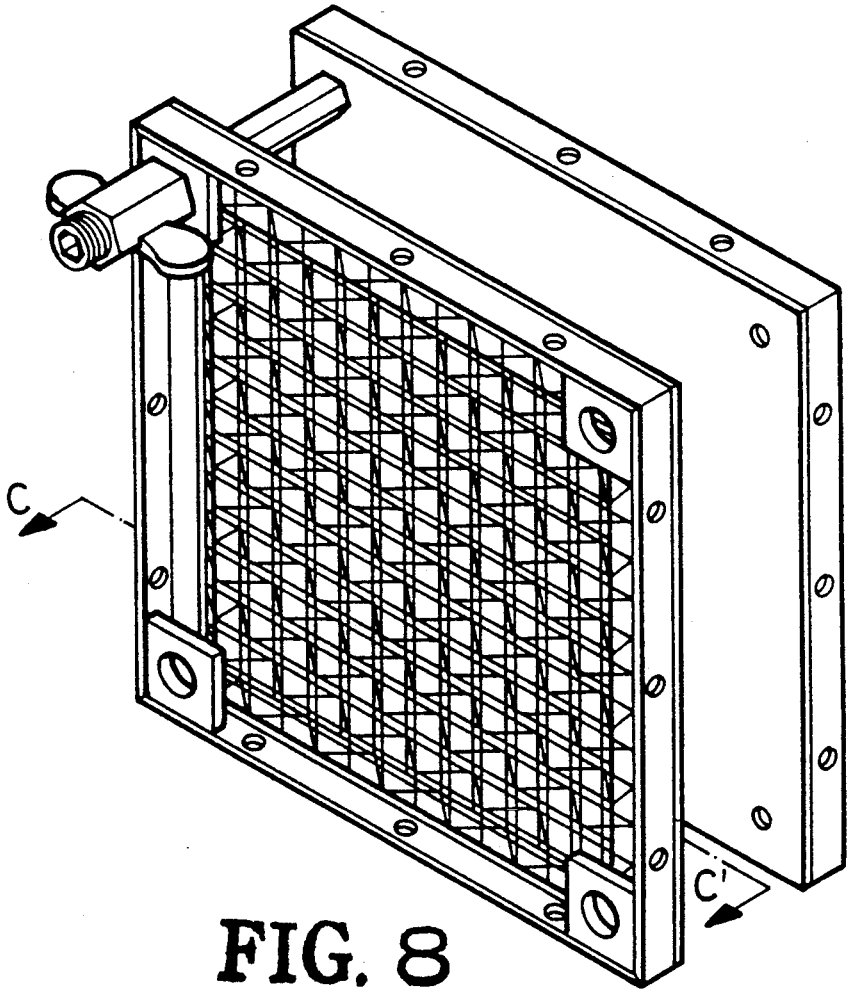
FIG. 8 shows the panel form of FIG. 7 from its top border view with its relation to an opposed panel form.
Figure 10:
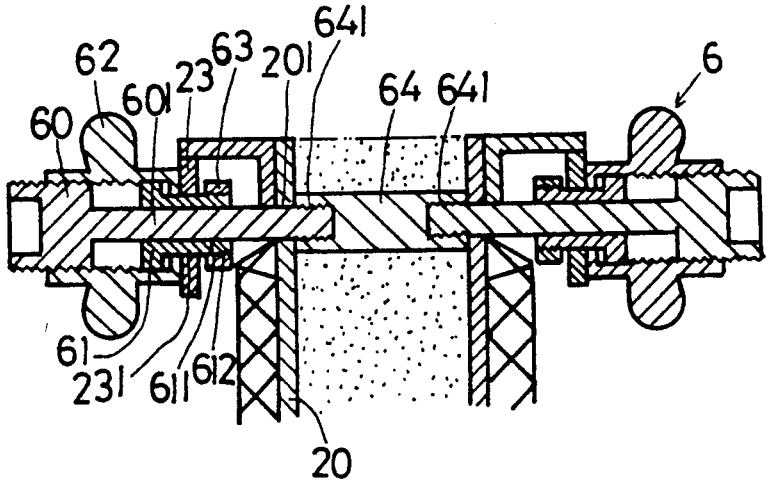
FIG. 10 is an enlarged sectional view of a joining section of the two opposed panel forms of the second embodiment after molding a concrete wall.
Figure 11:
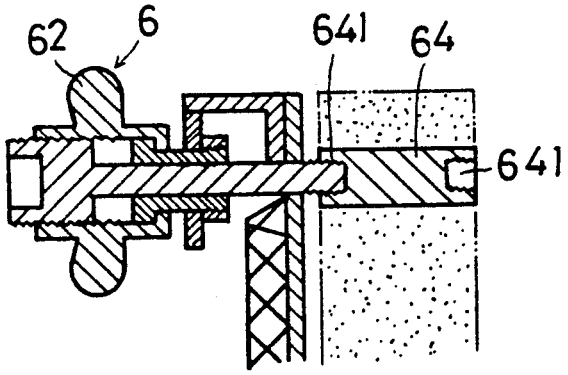
FIG. 11 is an enlarged sectional view of the joining section of the two opposed panel forms, shown in FIG. 10, which are half disassembled after molding a concrete wall.

A spreader 6 of this second embodiment is illustrated in details in FIGS. 7, 10 and 11, where it is seen to comprise a hexagonal spacing nut 64 formed with two inner screw holes 641 in the opposite ends thereof and two fasteners are threaded into the spacing nut 64 from inner side of opposed panel forms. Each fastener comprises an elongate, cylindrical screw body 60 having an externally threaded end 600 of larger diameter and a shank 601 of smaller diameter formed with a threaded end 602, a sleeve member 61 formed with a central passage 611 extending therethrough for receiving the shank 601 of the screw body 60, a flange head 610 and an externally threaded end 612, and a wing nut 62 formed with an internal thread 621 intermeshable with the external thread 600 of the screw body 60 and an inner flange 622 in the outer end for restricting the flange head 610 of the sleeve member 61 and allowing passing through and extruding outwards of the threaded end 612 and a nut 63 being adapted to engage the external thread 612 of the sleeve member 62. In assembly of the fastener, as best shown in FIG. 10, the shank 601 of the screw body 60 extends through the central passage 611 of the sleeve member 61, the central passage of the wing nut 62 and the hole 201 of the plate 20 to be threaded tightly into a screw hole 641 in the spacing nut 64 which is now located between two opposed panel forms. The threaded end 612 of the sleeve member 61 protrudes from the inner flange 622 of the wing nut and extends through the screw hole 231 in the corner reinforcement piece 23, then the nut 63 is tightly threaded onto the externally threaded end 612 of the sleeve member 61 to secured the wing screw 62 on the reinforcement piece 23. The length of the spacer 64 determines the space between panel forms.

Figure 12:
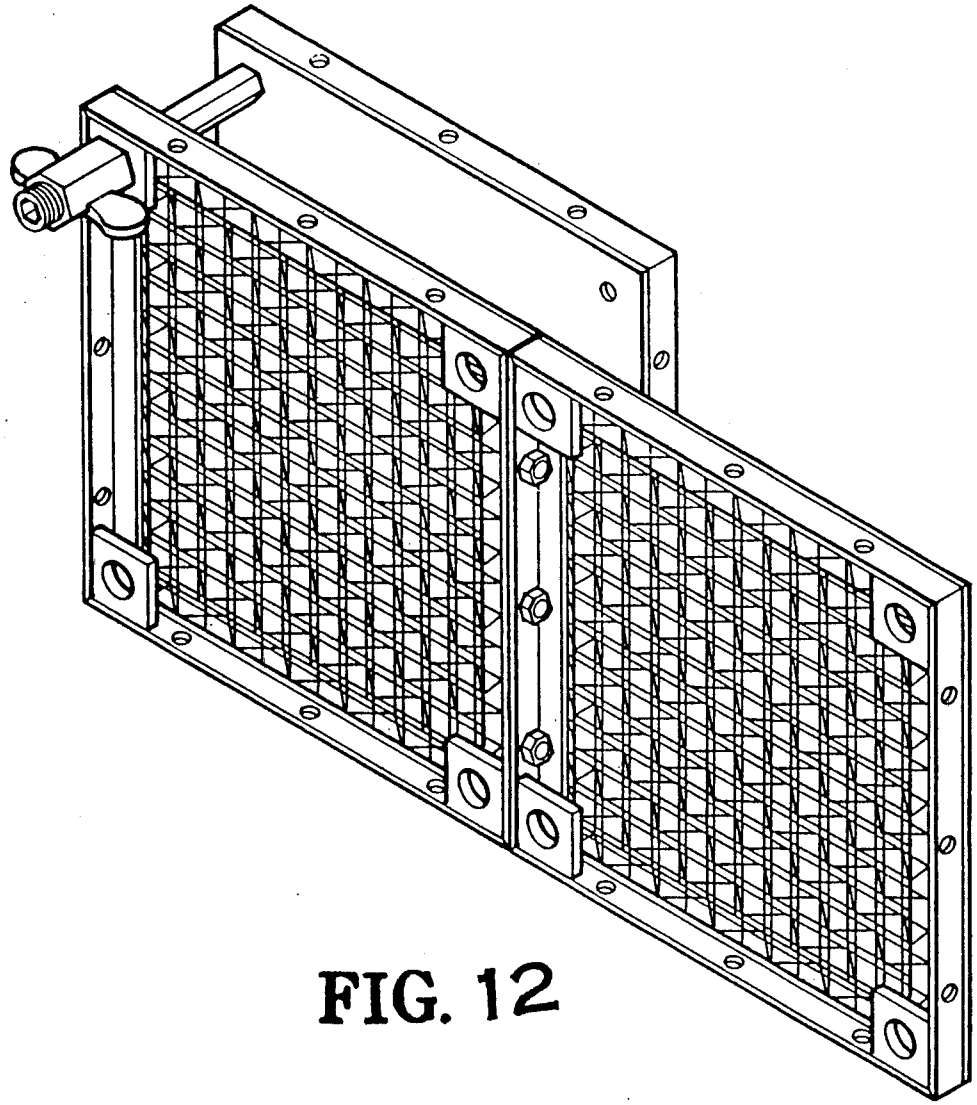
FIG. 12 shows the panel form of FIG. 7 from its top border view with its relation to an opposed and an adjacent panel forms.

The forms once established as aforesaid and best shown in FIG. 12 may be filled with concrete in the traditional fashion and the concrete allowed to set. When appropriately set, the panel forms are stripped from the adjacent finished concrete surface by loosening the wing screw 62 of the fastener 6.

From the foregoing, it is to be particularly noted that all the elements of the present invention are performed and not necessarily configured to a particular structure or job so that they, except the hexagonal spacing nut 64, might be quite reusable. Similarly, the elements are not deformed or otherwise deteriorated by use.

It is further to be noted that the separation of the panel forms from the adjacent finished concrete surface can be smoothly achieved simply by loosening the wing screw of the fasteners.

What is claimed is:

1. A form for walls and the like, formed by two parallel, molding surfaces forming the outer surfaces of the wall to be molded, wherein each of the two surfaces is formed by a plurality of panels, each of the panels comprising a rigid rectangular frame constituted with two pairs of opposed angle irons, each of the angle irons having a main plate arrayed with a plurality of spacing holes and a bent plate, a rigid plate with a major side attached to the bent plate of the frame, a cellular reinforcing body made of a plurality of stacked wavy metallic strips surrounded by two spaced wire nets one of which is adjacent and secured to the major side of the plate, and a plurality of spacing units extending through said panels defining the molding surfaces.

2. The form of claim 1 wherein the spacing units comprise generally U-shaped spacers simultaneously extending through adjacent panels of two opposed layers defining the molding surfaces.

3. The form of claim 1 wherein the two parallel molding surfaces face in opposite directions.

4. The form of claim 1 wherein each of the two molding surfaces is formed by a plurality of panels in coplanar arrangement.

* * * * *